US007105997B1

(12) United States Patent
Hu

(10) Patent No.: US 7,105,997 B1
(45) Date of Patent: Sep. 12, 2006

(54) FIELD EMITTER DEVICES WITH EMITTERS HAVING IMPLANTED LAYER

(75) Inventor: Yongjun Hu, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/387,164

(22) Filed: Aug. 31, 1999

(51) Int. Cl.
*H01J 1/30* (2006.01)
*H01J 9/00* (2006.01)

(52) U.S. Cl. ..... 313/495; 313/309; 313/336; 313/311; 313/497; 445/24; 445/50

(58) Field of Classification Search ..... 313/309, 313/308, 336, 495, 496, 497; 445/24, 50
See application file for complete search history.

(56) References Cited

U.S. PATENT DOCUMENTS 4,386,968 A * 6/1983 Hinkel et al. ..... 438/369
4,801,994 A * 1/1989 Van Gorkom et al. ..... 313/366
5,141,460 A * 8/1992 Jaskie et al. ..... 445/24
5,201,992 A * 4/1993 Andreadakis et al. ..... 216/11
5,311,055 A * 5/1994 Goodman et al. ..... 257/593
5,372,973 A * 12/1994 Doan et al. ..... 437/228
5,420,054 A * 5/1995 Choi et al. ..... 438/20
5,534,743 A * 7/1996 Jones et al. ..... 313/309
5,666,020 A * 9/1997 Takemura ..... 313/306
5,688,707 A * 11/1997 Lee et al. ..... 438/20
5,696,028 A 12/1997 Rolfson et al. ..... 437/228
5,817,201 A * 10/1998 Greschner et al. ..... 156/150
5,831,378 A 11/1998 Rolfson et al. ..... 313/336
5,857,882 A * 1/1999 Pam et al. ..... 445/6
5,885,124 A * 3/1999 Hattori ..... 445/24
5,921,838 A * 7/1999 Pack et al. ..... 445/50
5,923,948 A * 7/1999 Cathey, Jr. ..... 438/20
5,977,698 A * 11/1999 Lee ..... 313/336
5,993,281 A * 11/1999 Musket ..... 445/50
6,017,257 A * 1/2000 Potter ..... 445/24
6,069,018 A * 5/2000 Song et al. ..... 438/20
6,124,670 A * 9/2000 Valone ..... 313/495
6,130,106 A * 10/2000 Zimlich ..... 438/20
6,165,808 A * 12/2000 Zhang ..... 438/20
6,232,705 B1 * 5/2001 Forbes et al. ..... 313/309

FOREIGN PATENT DOCUMENTS

JP 2000090811 * 3/2000

* cited by examiner

*Primary Examiner*—Karabi Guharay
*Assistant Examiner*—Sikha Roy
(74) *Attorney, Agent, or Firm*—Schwegman, Lundberg, Woessner & Kluth, P.A.

(57) ABSTRACT

Structures and methods to ease electron emission and limit outgassing so as to inhibit degradation to the electron beam of a field emitter device are described. In one method to ease such electron emission, a layer of low relative dielectric constant material is formed under the surface of the field emitter tip. Another method is to coat the field emitter tip with a low relative dielectric constant substance or compound to form a layer and then cover that layer with a thin layer of the material of the field emitter tip.

33 Claims, 12 Drawing Sheets

FIELD EMITTER DEVICES WITH EMITTERS HAVING IMPLANTED LAYER

FIELD OF THE INVENTION

The present invention relates generally to semiconductor integrated circuits. More particularly, it pertains to structures and methods to enhance electron emission in a field emitter device.

BACKGROUND OF THE INVENTION

Recent years have seen an increased interest in field emitter displays. This is attributable to the fact that such displays can fulfill the goal of being consumer-affordable hang-on-the-wall flat panel television displays with diagonals in the range of 20 to 60 inches. Certain field emitter displays operate on the same physical principles as cathode ray tube (CRT) based displays. Excited electrons are guided to a phosphor target to create a display. The phosphor then emits photons in the visible spectrum. This method of operation for field emitter displays relies on an array of field emitter tips.

Although field emitter displays promise to provide better color and image resolution, one of their problems is that it is difficult to get the field emitter to emit electrons so as to strike the phosphor target to generate the display. Another problem is that video images on these displays tend to take on undesired viewing characteristics over a relative short period of time. These undesired characteristics might be caused by degradation of the field emitter display due to certain conditions near the vicinity of the field emitter displays. These issues raise questions about the commercial success of the displays in the marketplace.

Thus, what is needed are structures and methods to enhance the emission of electrons in field emitter displays while dealing with the degradation of the field emitter over time.

SUMMARY OF THE INVENTION

The above mentioned problems with field emitter displays and other problems are addressed by the present invention and will be understood by reading and studying the following specification. Structures and methods are described which accord these benefits.

In particular, an illustrative embodiment of the present invention includes a field emitter display device. This device comprises at least one emitter having an implantation that releases electrons at a predetermined energy level. The implantation enhances the releasing of electrons. The implantation also acts to limit outgassing so as to inhibit the degradation of the at least one emitter. In one embodiment, this implantation is embedded in the surface of the emitter.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1A:
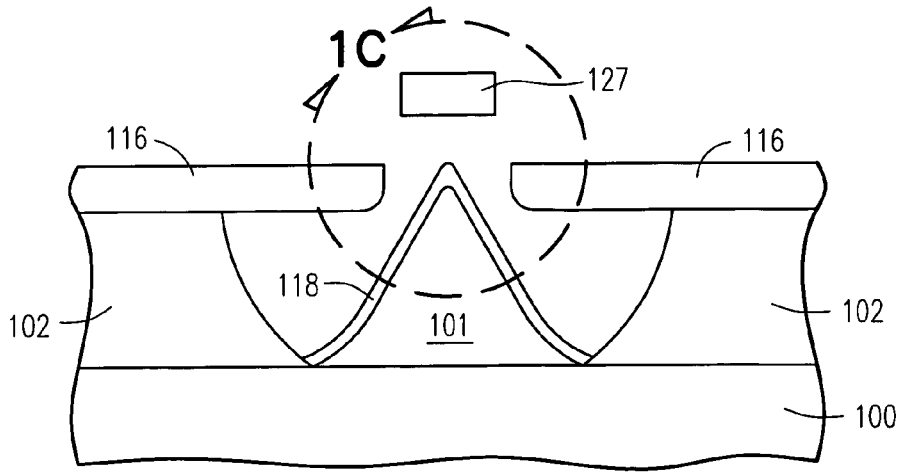
FIGS. 1A–1C are a close-up illustration of an emitter tip according to one embodiment of the present invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures during processing, and may include other layers that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less electrically conductive than the materials referred to as conductors. The following detailed description is, therefore, not to be taken in a limiting sense, and the scope of the present invention is defined only by the appended claims, along with the full scope of equivalents to which such claims are entitled.

The term "horizontal" as used in this application is defined as a plane parallel to the conventional plane or surface of a wafer or substrate, regardless of the orientation of the wafer or substrate. The term "vertical" refers to a direction perpendicular to the horizontal as defined above. Prepositions, such as "on," "side" (as in "sidewall"), "higher," "lower," "over," and "under" are defined with respect to the conventional plane or surface being on the top surface of the wafer or substrate, regardless of the orientation of the wafer or substrate.

In the process of identifying ways to emit electrons, it was discovered that the physical characteristics of the field emitter itself might be affecting the emission of electrons. Additionally, it was discovered that the beam of emitted electrons is smaller in those field emitter displays suffering from image quality degradation. These degraded field emitters were found to be surrounded by substances and compounds near the vicinity of the field emitters. Because the emitted electrons are the product of the array of tips in the field emitter display, the tip is discussed in detail below.

FIG. 1A shows an embodiment of an emitter tip according to an embodiment of the present invention. A field emitter device 120 includes a substrate 100, a cathode tip 101 formed on the substrate 100, gate insulator layer 102, gate lines 116, and a phosphorescent anode 127 in opposing position with respect to the cathode tip 101. The construction of those elements of the field emitter device 120 will be explained below in other figures.

The cathode tip 101 emits electrons in response to the presence of an electromagnetic field. The phosphorescent anode 127 releases photons when the emitted electrons strike the surface of the phosphorescent anode 127. An array of cathode tips 101 and phosphorescent anodes 127 forms the field emitter display. Video images are shown on the display as a result of the input of visual signals being modulated by the array of cathode tips 101 and phosphorescent anodes 127.

The cathode tip 101 includes an implantation 118. This implantation 118 affects the physical characteristics of the cathode tip 101 to enhance the releasing of electrons. This will be discussed below. Without this implantation 118, a strong electric field can be used to coerce the cathode tip 101 to emit more electrons.

Figure 1B:
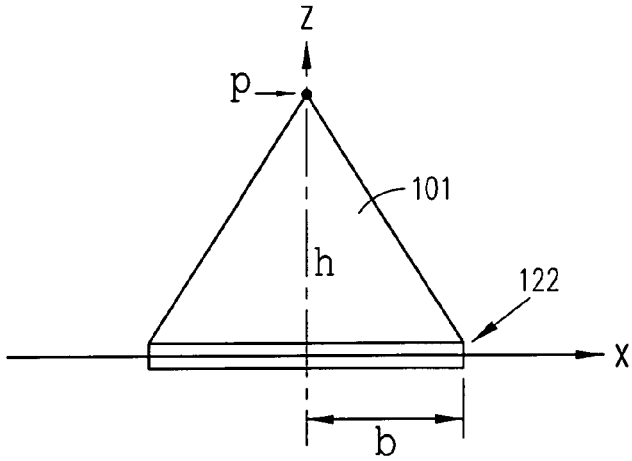

FIG. 1B shows a method of increasing the emission of electrons through the use of a strong electric field. For illustrative purposes only, the cathode tip 101 is shown as a cone with base radius b and height h. For simplifying the analysis, a circular disk 122 of radius b with uniform surface charge density $\sigma$ is assumed. This circular disk lies in the x plane with its center at the origin.

Since electrons are emitted at point P, the behavior of the electric field at point P is investigated. From FIG. 1B, the contribution of the charges on opposite sides of the circular disk 122 to the electric field in the x direction is canceled. However, the contribution of charges to the electric field in the z direction is cumulative. Therefore, the electric field at point P contains only the component in the z direction.

It is understood from the science of electromagnetism that the electric field of point P measuring from circular disk 122 is given by the equation: $E_z=(\sigma/2\epsilon)(1-(h/(h^2+b^2)^{1/2}))$. $E_z$ is the electric field in the z direction, $\epsilon$ is the permitivity, h is the height of the cone 101, and b is the radius of the cone 101.

Therefore, the electric field is directly proportional to $\sigma$ and inversely proportional to the radius b of the cone 101. Increasing the electric field would increase the emission of electrons. Thus to increase the emission of electrons, more charges must be supplied because of $\sigma$ this would mean imposing a larger potential across the cathode tip 101. Another way to increase the emission of electrons would be to make the tip of the cathode tip 101 sharper; this is accomplished by making the radius b smaller.

Figure 1C:
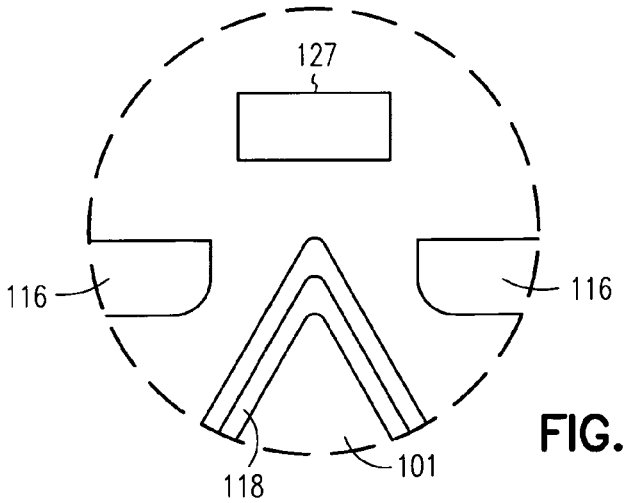

FIG. 1C shows the cathode tip 101 with the implantation 118 being conforming to the entire surface of cathode tip 101. This implantation 118 enhances the releasing of electrons without the need to increase the strength of the electric field. However, in one embodiment, electron emission is further enhanced by using the implantation 118 with an increase in the strength of the electric field.

Another benefit of the implantation 118 is that it allows the cathode tip 101 to limit outgassing, which has deteriorating effects upon the field emitter. One way to understand the problem of outgassing is to look at a measurement called the work function. The work function is a quantity of energy that must be supplied to move the electron from the surface of the cathode tip 101. Electrons that are more tightly bound within the cathode tip 101 require more energy to move. Different materials have different work functions. The cathode tip 101 without the implantation 118 is a source of outgassed materials. These outgassed materials increase the bond that binds the electron in the emitter tip. Therefore, the work function of the cathode tip 101 without the implantation 118 is increased in the presence of outgassing. As a result, the size of the emitted electron beam is reduced.

Outgassed substances and compounds exist in the environment near the vicinity of the cathode tip 101. The anode 127, the site that releases photons upon contact by the emitted electrons from the cathode tip 101, is one source of the outgassing. Another source is the cathode tip 101. The outgassing may contain carbon-based compounds, oxygen, hydrogen, water, argon, nitrogen, moisture, and others. In the absence of implantation 118, these outgassed substances and compounds act against the cathode tip 101. Once the physical structure of the emitter tip is degraded, the size of the emitted electron beam is correspondingly reduced.

The implantation 118 helps the cathode tip 101 to be stable to limit outgassing so as to inhibit degradation to the cathode tip 101. Stable is understood to mean the inclusion of resistance to forces that disturb or alter the chemical makeup or physical state of the cathode tip 101. In one embodiment, inhibit is understood to mean the inclusion of substantial resistance to the degradation of the cathode tip 101. In another embodiment, inhibit is understood to mean the inclusion of a complete prevention of degradation of the cathode tip 101.

Figure 2:
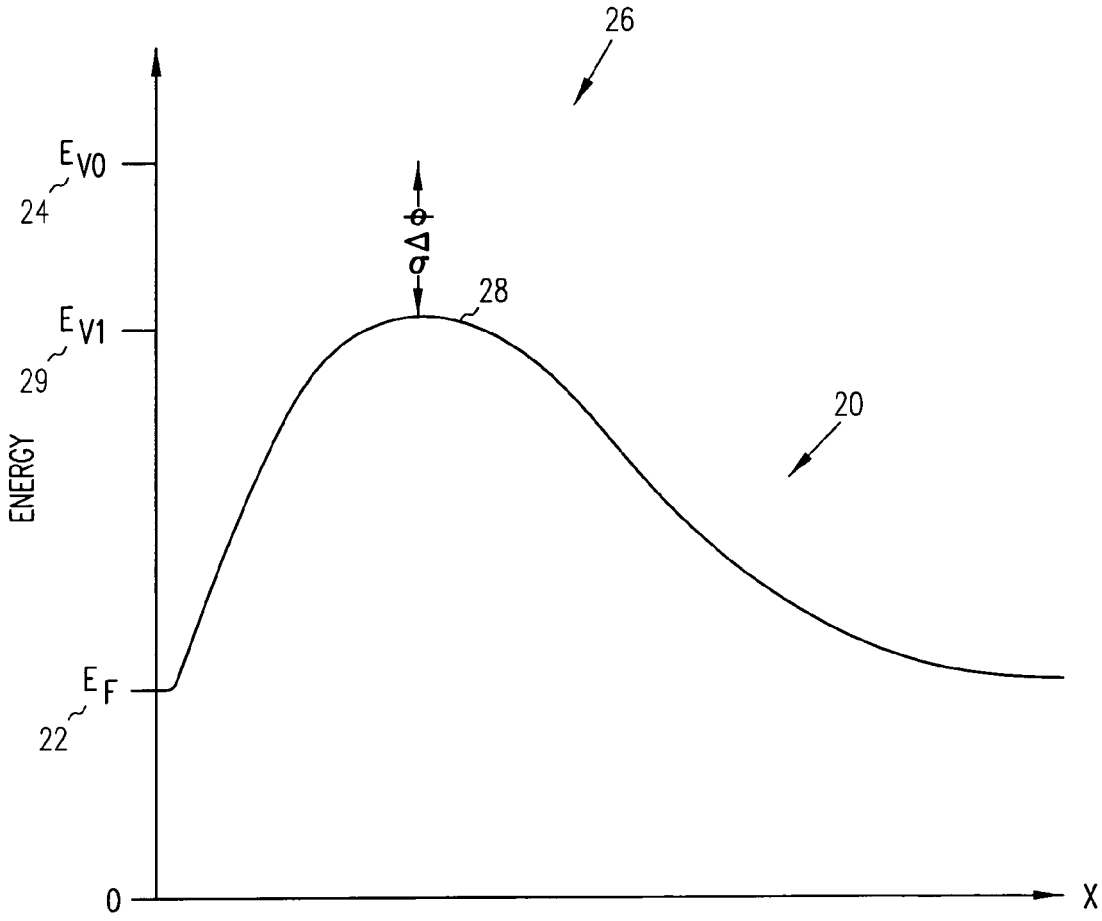
FIG. 2 is an illustration of energy levels of field emitters according to one embodiment of the present invention.

FIG. 2 is a graph of energy levels of a field emitter according to one embodiment of the present invention. The graph represents a potential barrier (or potential hill) 20 that has been lowered because of the presence of an energy quantity $q\Delta\phi$. An electron must climb to the top 28 of the potential hill to free itself from the field emitter tip to reach the phosphorescent anode.

The potential hill 20 includes Fermi level 22. This level is symbolically represented by $E_F$. $E_F$ is derived from Fermi-Dirac statistical analysis. It is understood that $E_F$ represents the symmetrical reference point for the probability that a quantity of charges would exist or not exist above and below $E_F$. For illustrative purposes in the present embodiment, $E_F$ is a likely starting point for an electron to begin its ascent to the top 28 to free itself from the tip of the field emitter.

The level 24 ($E_{v0}$) is an energy level, without $q\Delta\phi$, that an electron must reach to free itself from the tip of the field emitter. However, in the presence of $q\Delta\phi$, the level $E_{v0}$ is reduced to $E_{v1}$. At level $E_{v1}$, an electron may free itself with less effort from the tip of the field emitter to reach the phosphorescent anode 127.

The energy quantity $q\Delta\phi$ is composed of the magnitude of the electronic charge, q, and $\Delta\phi$. $\Delta\phi$ is a lowering mechanism that reduces the potential hill 20. In one embodiment, $\Delta\phi$ is described as $\Delta\phi=(qE/4\pi\epsilon_s)^{1/2}$, where:

$\Delta\phi$ is in volts.

q is in coulombs. q is the magnitude of the electronic charge.

E is in newtons per coulomb. E is the electric field.

$\epsilon_s$ is in coulombs per volt-meter. $\epsilon_s$ is the permitivity of the material of the emiter tip. In one embodiment, $\epsilon_s$ represents the permitivity of silicon.

Thus to lower the potential hill 20 to allow electrons to escape the field emitter tip, the quantity $q\Delta\phi$ should be increased. Since q is a constant, the controllable quantity is $\Delta\phi$. To increase $\Delta\phi$ would require either increasing the electric field E, decreasing the permitivity $\epsilon_s$ of the material of the emitter tip, or both. It is understood that $\epsilon_s$ is described as $\epsilon_s=\epsilon_r\epsilon_0$, where:

$\epsilon_r$ is the relative dielectric constant of the material of the emitter tip.

$\epsilon_0$ is in coulombs per volt-meter. $\epsilon_0$ is the permitivity of free space.

To decrease the permitivity $\epsilon_s$ of the material of the emitter tip would require decreasing the relative dielectric constant $\epsilon_r$ since the permitivity of free space $\epsilon_0$ is a constant. In one embodiment, the relative dielectric constant $\epsilon_r$ is the relative dielectric constant of silicon.

Another way to understand how emission of electrons can be eased is to improve the image force. An image force is created when negative charges are brought near the surface of the cathode tip's surface. Positive charges are attracted to such negative charges and will be induced under the surface of the cathode tip. Such induction creates a force that, when combined with an external electric field, would reduce the potential barrier. As previously mentioned, this potential barrier is the hill that electrons must escape to free themselves from the field emitter tip to reach the phosphorescent anode.

Yet another way to understand how emission of electrons can be eased is to increase the Schottky effect. This effect is realized when a semiconductor material is brought in contact with a layer of low relative dielectric constant material. In one embodiment, the Fermi level is moved so as to shorten the potential barrier that the electrons must climb to free themselves from the tip of the field emitter. In another embodiment, the top of the potential barrier is lowered.

In yet another way to understand the emission of electrons, by affecting the lowering mechanism, affecting the image force, improving the Schottky effect, or lowering the dielectric of the field emitter, the energy level by which the electrons must be excited to free them from the electronic bond with the nucleus of the material of the cathode tip and move them from the cathode tip is reduced.

Figure 3:
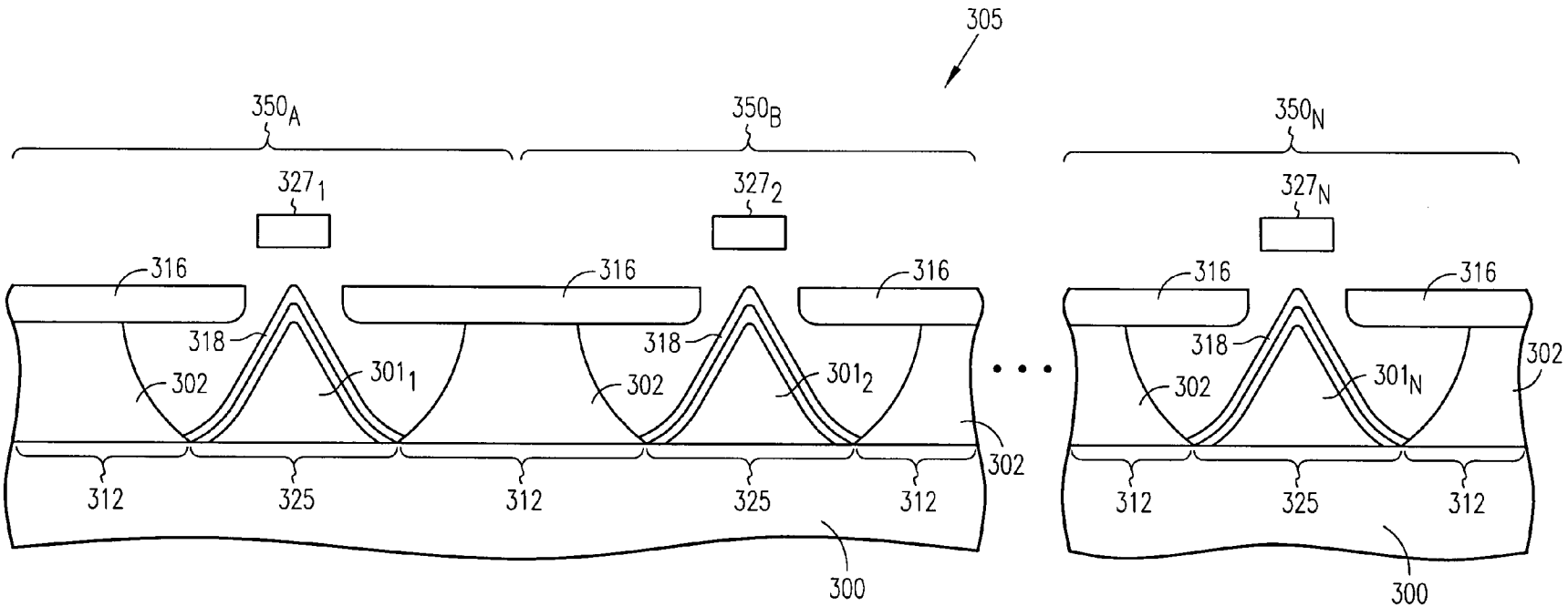
FIG. 3 is a planar view of a portion of an array of field emitters according to one embodiment of the present invention.

FIG. 3 is a planar view of an embodiment of a portion of an array of field emitter devices including 350A, 350B, 350C, . . . , 350N, and constructed according to an embodiment of the present invention. The field emitter array 305 includes a number of cathodes, $\mathbf{301}_1$, $\mathbf{301}_2$, $\mathbf{301}_3$, . . . , $\mathbf{301}_n$, formed in rows along a substrate 300. A gate insulator 302 is formed along the substrate 300 and surrounds the cathodes. A number of gate lines 316 are on the gate insulator. A number of anodes including $\mathbf{327}_1$, $\mathbf{327}_2$, $\mathbf{327}_3$, . . . , $\mathbf{327}_n$ are formed in columns orthogonal to and opposing the rows of cathodes. In one embodiment, the anodes include multiple phosphors. In another embodiment, the anodes are coated with phosphorescent or luminescent substances or compounds. Additionally, the intersections of the rows and columns form pixels.

Each field emitter device in the array, 350A, 350B, . . . , 350N, is constructed in a similar manner. Thus, only one field emitter device 350N is described herein in detail. All of the field emitter devices are formed along the surface of a substrate 300. In one embodiment, the substrate includes a doped silicon substrate 300. In an alternate embodiment, the substrate is a glass substrate 300, including silicon dioxide ($SiO_2$). Each field emitter device 350 includes a cathode 301 formed in a cathode region 325 of the substrate 300. The cathode 301 includes a polysilicon cone 301. In one exemplary embodiment, the polysilicon cone 301 includes an implantation 318.

A gate insulator 302 is formed in an insulator region 312 of the substrate 300. The cathode 301 and the gate insulator 302 have been formed, in one embodiment, from a single layer of polysilicon. A gate 316 is formed on the gate insulator 302.

An anode 327 opposes the cathode 301. In one embodiment, the anode is covered with light emitting substances or compounds that are luminescent or phosphorescent.

Figure 4A:
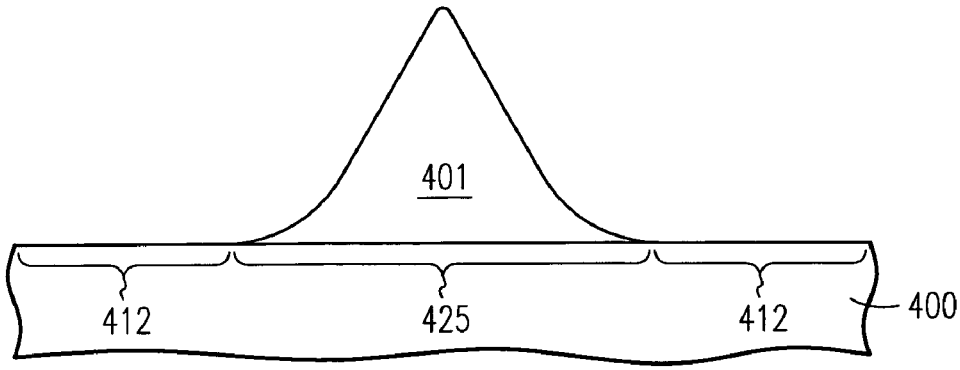
FIGS. 4A–4G are planar views of a field emitter device during various stages of fabrication according to one embodiment of the present invention.

FIGS. 4A–4G show a process of fabrication for a field emitter device according to one embodiment of the present invention. FIG. 4A shows the structure focusing on the cathode tip, after tip sharpening, following the first stages of processing. One with ordinary skill in the art would be familiar with these stages of processing.

Figure 4B:
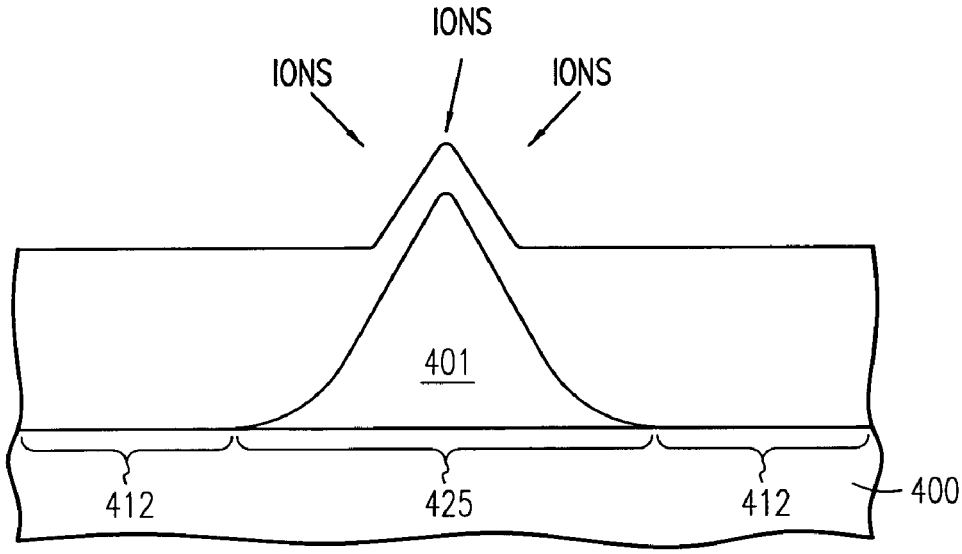

FIG. 4B shows the structure during an implantation of a dose of ions into a portion of the cathode tip 401. In one embodiment, the implantation is a shallow implantation using low energy. In another embodiment, the ions are implanted to form an implantation layer 418 at about 50 to 100 Angstroms from the surface of the portion of the cathode tip 401. In another embodiment, the dose of ions is a high dose that includes $10^{17}$ per square centimeter of ions. In another embodiment, the ion is one species of atomic oxygen, such as $O^-$. In another embodiment, the ion forms an oxide compound with the material of the cathode tip; in this embodiment, the ion includes $O^{2-}$ ions. In another embodiment, the ion forms a superoxide compound with the material of the cathode tip; in this embodiment, the ion includes $O^-_2$ ions. In another embodiment, the ion forms a peroxide compound with the material of the cathode tip. In one embodiment, the implantation layer 418 that is formed is a silicon oxide layer; it is understood that the relative dielectric constant of the silicon oxide layer with bubbles or other imperfections is approximately 3.0 whereas the relative dielectric constant of silicon is about 12. In yet another embodiment, the ion is one species of atomic nitrogen. In a further embodiment, the ion is an ionic nitride. It is understood that a compound of silicon nitride has a relative dielectric constant of about 7.5 whereas the relative dielectric constant of silicon is about 12.

Figure 4C:
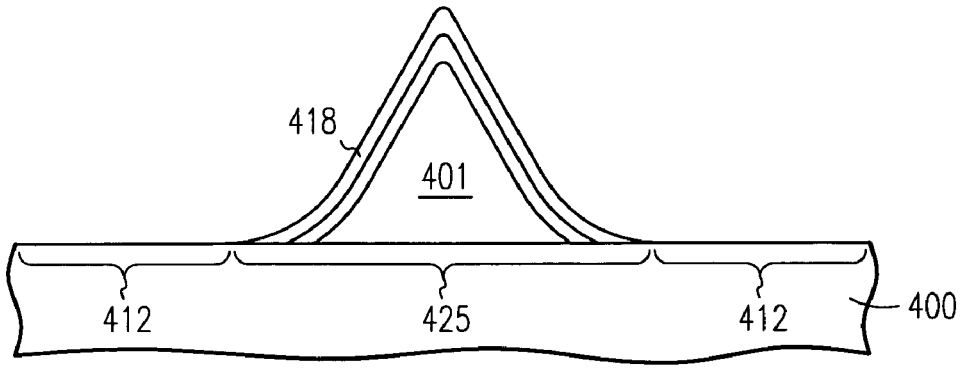

FIG. 4C shows the structure after the next sequence of fabrication stages. In one embodiment, an annealing process is used upon the cathode tip 401 to stabilize the ion implantation to form the implantation 418. The structure now appears as in FIG. 4C. In one embodiment, the annealing process is a rapid thermal process using nitrogen. The temperature range for such a process is about 850 degrees Celsius to about 1000 degrees Celsius.

Figure 4D:
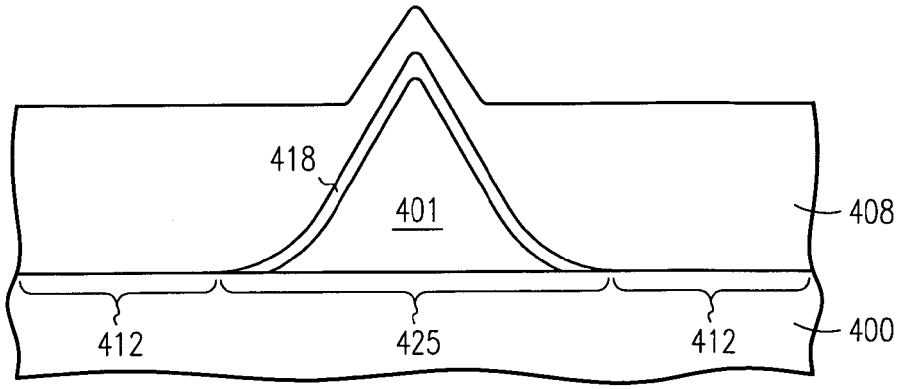

FIG. 4D shows the structure following the next sequence of processing. The insulator 408 may be referred to as a gate insulator or grid dielectric. The insulator 408 is formed over the cathode tip 401 and the substrate 400. The regions of the insulator 408 that surround the cathode tip 401 constitute an insulator region 412 for the field emitter device.

Figure 4E:
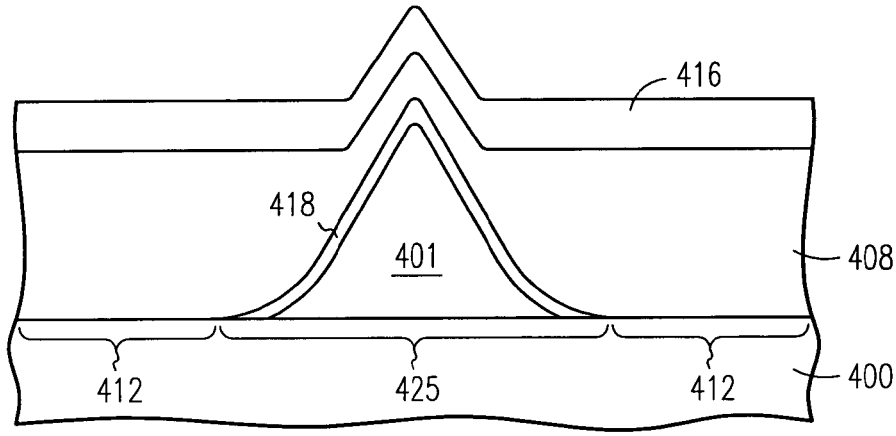

FIG. 4E shows the structure following the next stages of processing. A gate or gate layer 416 is formed on the insulator layer 408. The gate layer 416 includes any conductive layer material and can be formed using any suitable technique. One exemplary technique includes chemical vapor deposition (CVD).

Figure 4F:
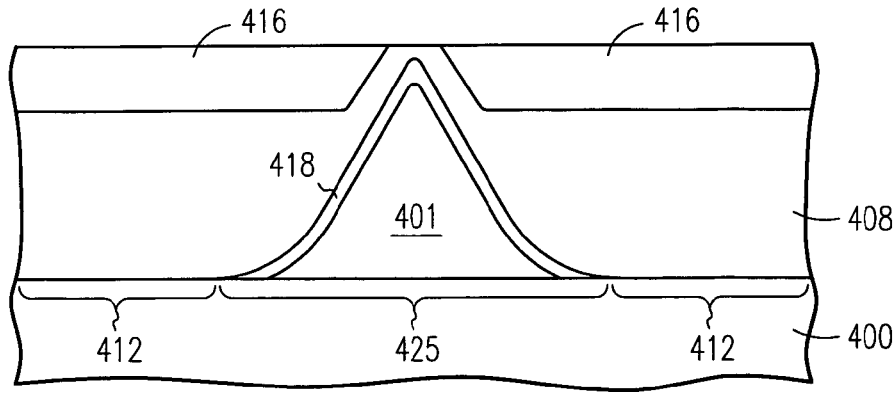

FIG. 4F shows the structure following the next stages of processing. Following deposition, the gate layer 416 undergoes a removal stage. In one embodiment, the gate layer 416 is removed until a portion of the insulator layer 408, covering the cathode tip 401, is revealed.

Figure 4G:
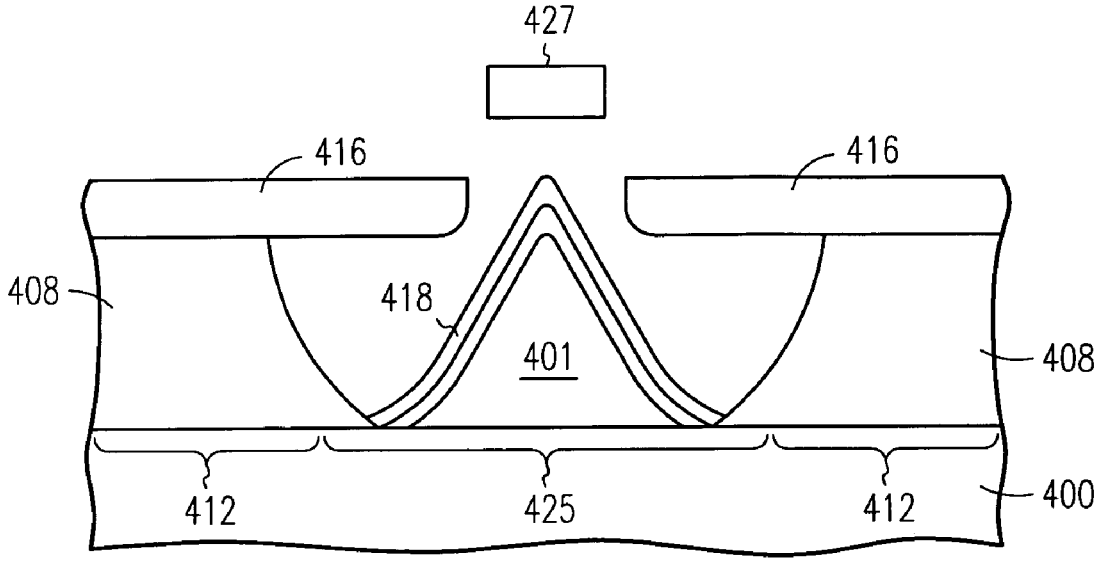

FIG. 4G shows the structure after the next sequence of processing. Here a portion of the insulator layer 408 is removed from the surrounding of the cathode tip 401. The portion of the insulator layer 408 is removed using any suitable technique as will be understood by one of ordinary skill in the field of semiconductor processing and field emission device fabrication; one exemplary technique includes using reactive ion etching. The formation of the anode 427 is further formed opposing the cathode tip 401 in order to complete the field emission device. The formation of the anode, and completion of the field emission device structure, can be achieved in numerous ways as will be understood by those of ordinary skill in the art of semiconductor and field emission device fabrication.

Figure 5A:
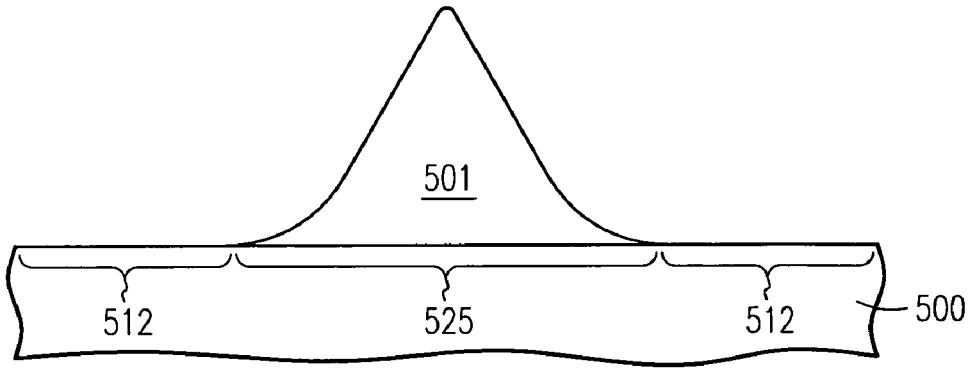
FIGS. 5A–5H are planar views of a field emitter device during various stages of fabrication according to another embodiment of the present invention.

FIGS. 5A–5H show fabrication of a field emitter device according to one embodiment of the present invention. FIG. 5A shows the structure focusing on the cathode tip, after tip sharpening, following the first stages of processing.

Figure 5B:
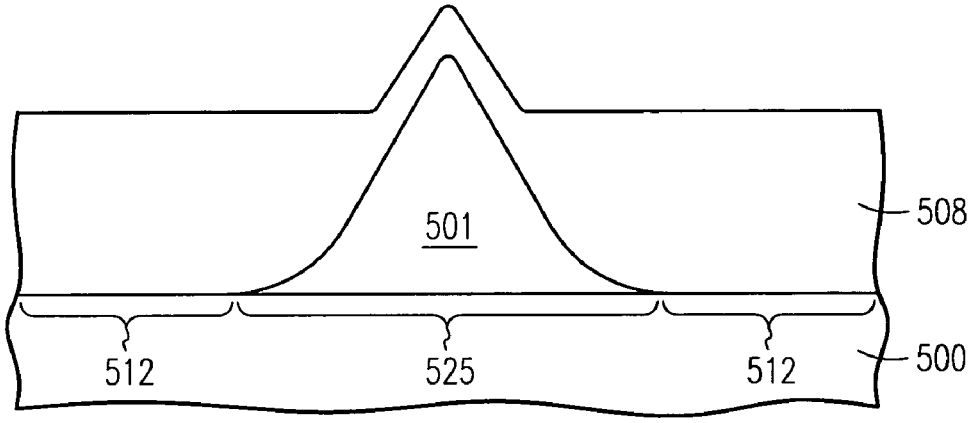

FIG. 5B shows the structure following the next sequence of processing. The insulator 508 is also known as a gate insulator, or grid dielectric. The insulator 508 is formed over the cathode tip 501 and the substrate 500. The regions of the insulator 508 that surround the cathode tip 501 constitute an insulator region 512 for the field emitter device.

Figure 5C:
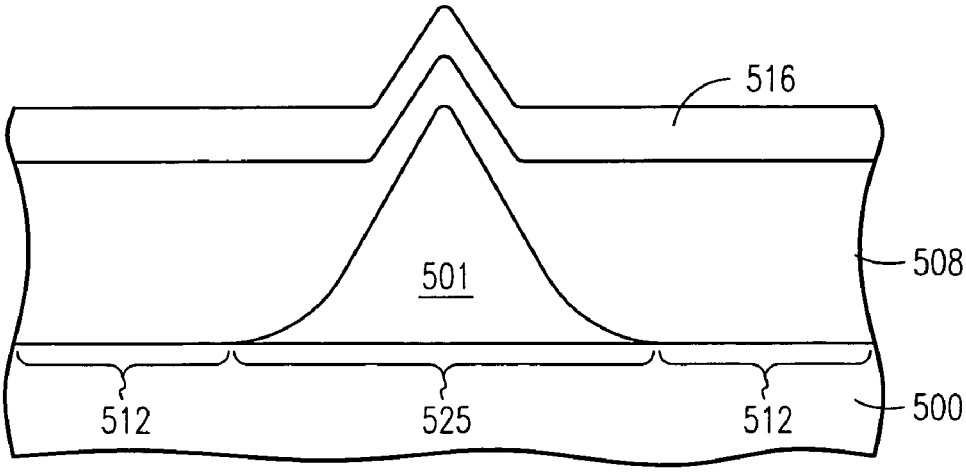

FIG. 5C shows the structure following the next stages of processing. A gate or gate layer 516 is formed on the insulator layer 508. The gate layer 516 includes any conductive layer material and can be formed using any suitable technique. One exemplary technique includes chemical vapor deposition (CVD).

Figure 5D:
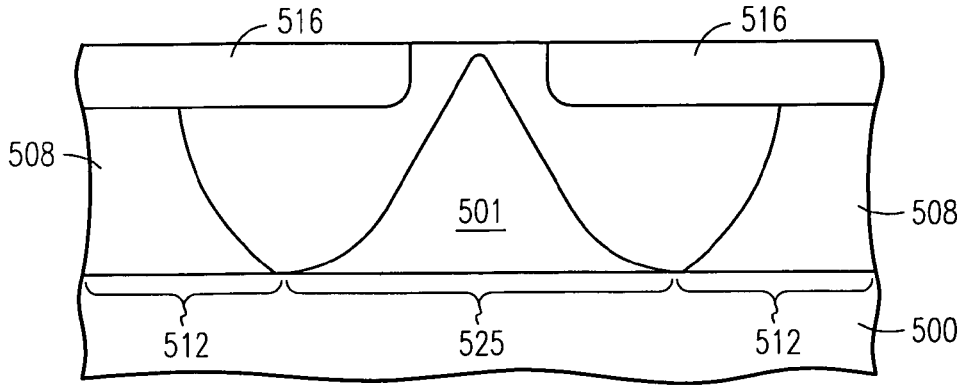

FIG. 5D shows the structure following the next stages of processing. Following deposition, the gate layer 516 undergoes a removal stage. The gate layer 516 is removed using a suitable technique until a portion of the insulator layer 508, covering the cathode tip 501, is revealed; one exemplary technique includes chemical mechanical planarization.

Figure 5E:
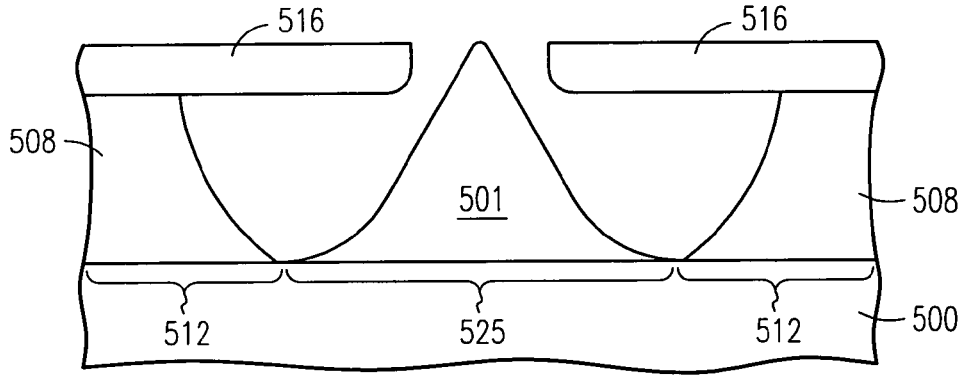

FIG. 5E shows the structure after the next sequence of processing. Here a portion of the insulator layer 508 is removed from the surrounding of the cathode tip 501. The portion of the insulator layer 508 is removed using any suitable technique as will be understood by one of ordinary skill in the field of semiconductor processing and field emission device fabrication; one exemplary technique includes a combination of a lift-off technique and reactive ion etching process.

Figure 5F:
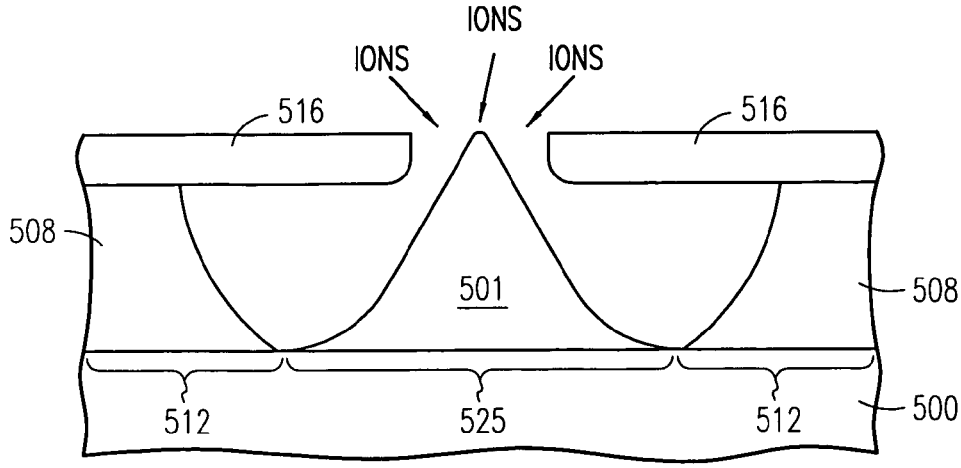

FIG. 5F shows the structure during an implantation of a dose of ions into a portion of the cathode tip 501. In one embodiment, the implantation is a shallow implantation using low energy. In another embodiment, the ions are implanted at about 50 to 100 Angstroms from the surface of the portion of the cathode tip 501. In another embodiment, the dose of ions is a high dose that includes 1017 per square centimeter of ions. In another embodiment, the ion is one species of atomic oxygen, such as O—. In another embodiment, the ion forms an oxide compound with the material of the cathode tip; in this embodiment, the ion includes O2— ions. In another embodiment, the ion forms a superoxide compound with the material of the cathode tip; in this embodiment, the ion includes O-2 ions. In one embodiment, the implantation layer that is formed is a silicon oxide layer; it is understood that the relative dielectric constant of the silicon oxide layer is approximately 4 whereas the relative dielectric constant of silicon is about 12. In yet another embodiment, the ion is one species of atomic nitrogen. In a further embodiment, the ion is an ionic nitride. It is understood that a compound of silicon nitride has a relative dielectric constant of approximately 7.5 whereas the relative dielectric constant of silicon is about 12.

Figure 5G:
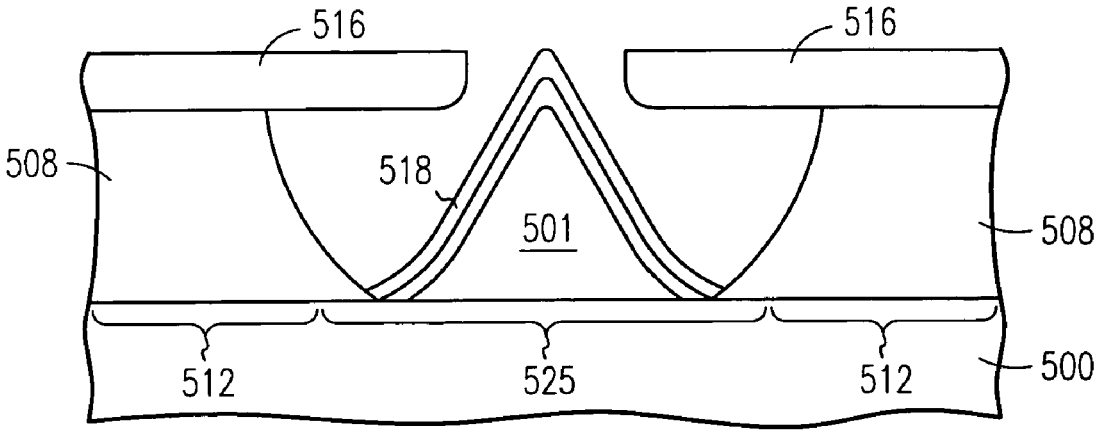

FIG. 5G shows the structure after the next sequence of fabrication stages. In one embodiment, an annealing process is used upon the cathode tip 501 to stabilize the ion implantation to form the implantation 518. The structure now appears as in FIG. 5G. In one embodiment, the annealing process is a rapid thermal process using nitrogen. In a further embodiment, the temperature range for such a process is about 850 degrees Celsius to about 1000 degrees Celsius.

Figure 5H:
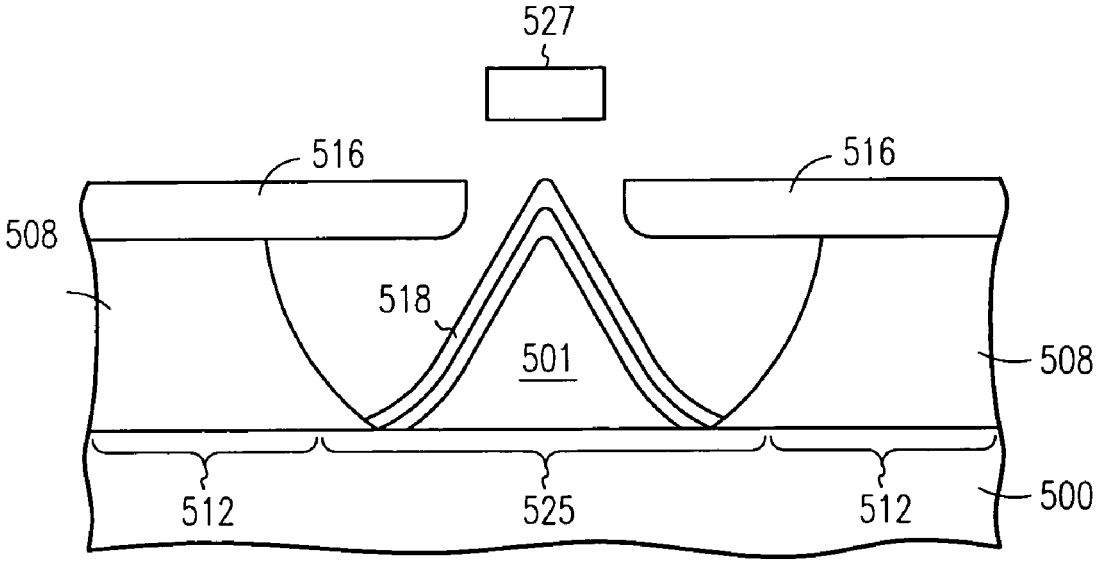

FIG. 5H shows the structure after the next sequence of processing. The formation of the anode 527 is further formed opposing the cathode tip 501 in order to complete the field emission device. The formation of the anode, and the completion of the field emission device structure, can be achieved in numerous ways as will be understood by those of ordinary skill in the art of semiconductor and field emission device fabrication. The formation of the anodes, and completion of the field emission device itself, do not limit the present invention and as such are not presented in full detail here.

Figure 6A:
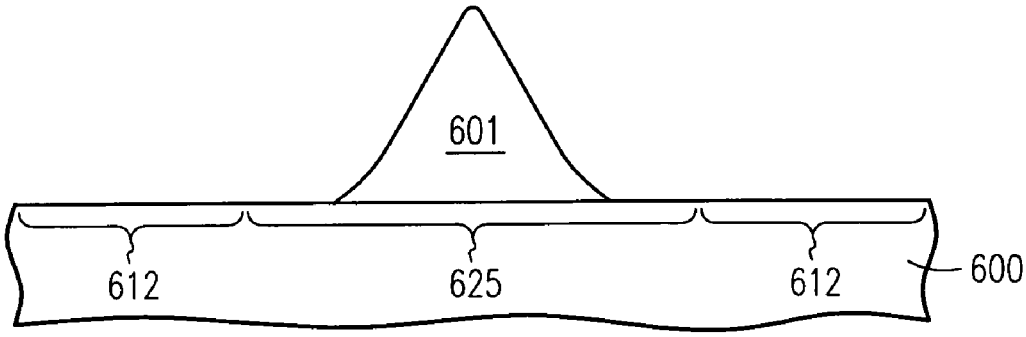
FIGS. 6A–6G are planar views of a field emitter device during various stages of fabrication according to another embodiment of the present invention.

FIGS. 6A–6G show a process of fabrication for a field emitter device according to an embodiment of the present invention. FIG. 6A shows the structure focusing on the cathode tip, after tip sharpening, following the first stages of processing. One with ordinary skill in the art would be familiar with these stages of processing.

Figure 6B:
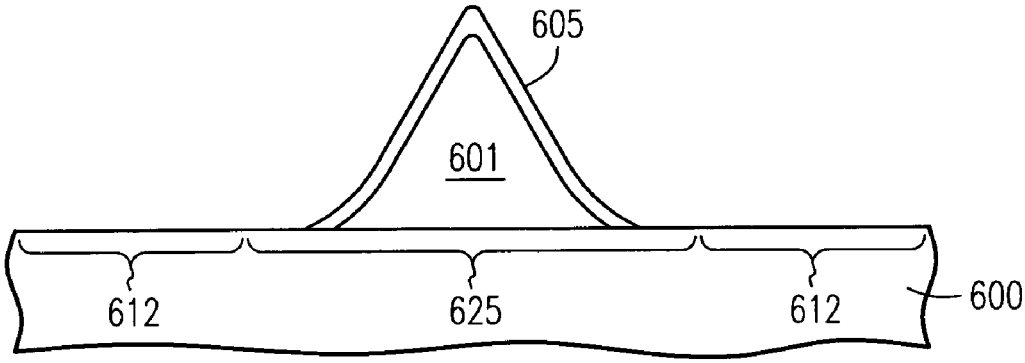

FIG. 6B shows the structure during the process of implantation of at least a portion of the cathode tip 601 with a layer 605 of low relative dielectric constant material. In one embodiment, a uniform-step-coverage technique is used to apply layer 605 of the low relative dielectric constant material with uniform thickness. In one embodiment, layer 605 of low relative dielectric constant has a value less than about the relative dielectric constant of the material of the cathode tip 601. In another embodiment, layer 605 of low relative dielectric constant has a value less than about 50 percent of the relative dielectric constant of the material of the cathode tip 601. In another embodiment, layer 605 of low relative dielectric constant has a value less than about 5. In yet another embodiment, layer 605 of low relative dielectric constant has a value less than about 12.

Figure 6C:
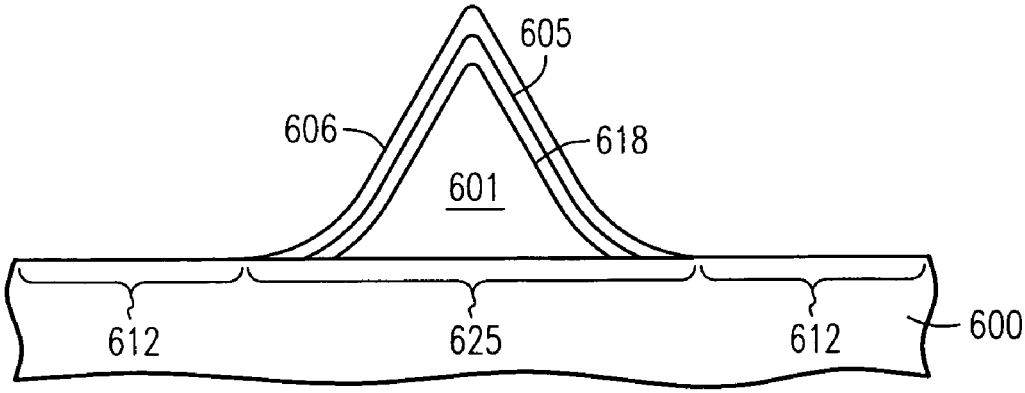

FIG. 6C shows the structure after the next sequence of fabrication stages. In one embodiment, a layer of silicon 606 is used to cover the layer 605. In another embodiment, the silicon layer 606 includes a thickness of 50 to 100 Angstroms. Having covered up the layer 605 with the layer of amorphous silicon 606, an implantation 618 is defined. In one embodiment, the layer of silicon 606 is continuous. In another embodiment, the layer of silicon 606 is a thin film, about 50 to 100 Angstroms. Reducing the thickness of the layer of silicon 606 tends to reduce outgassing within the vicinity of the cathode tip 601.

Figure 6D:
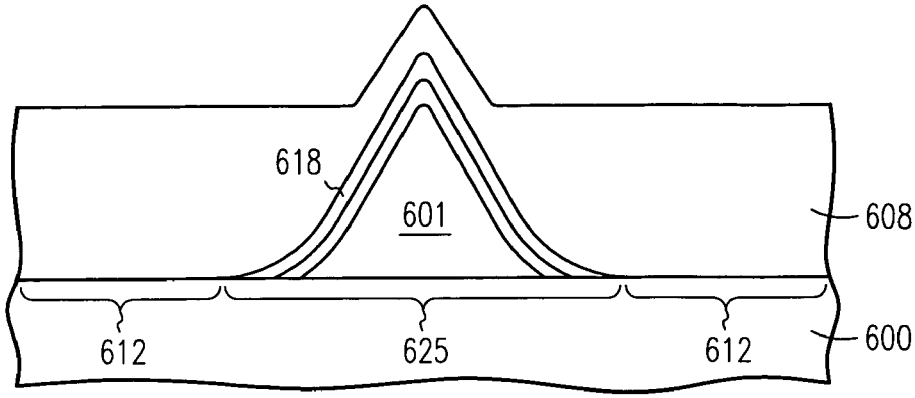

FIG. 6D shows the structure following the next sequence of processing. The insulator 608 may be referred to as a gate insulator or grid dielectric. The insulator 608 is formed over the cathode tip 601 and the substrate 600. The regions of the insulator 608 that surround the cathode tip 601 constitute an insulator region 612 for the field emitter device.

Figure 6E:
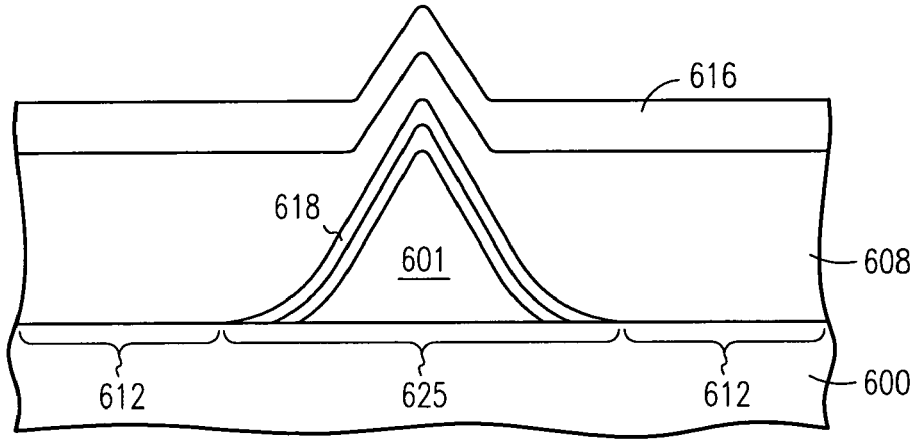

FIG. 6E shows the structure following the next stages of processing. A gate, or gate layer 616, is formed on the insulator layer 608. The gate layer 616 includes any conductive layer material and can be formed using any suitable technique, such as sputtering or chemical vapor deposition.

Figure 6F:
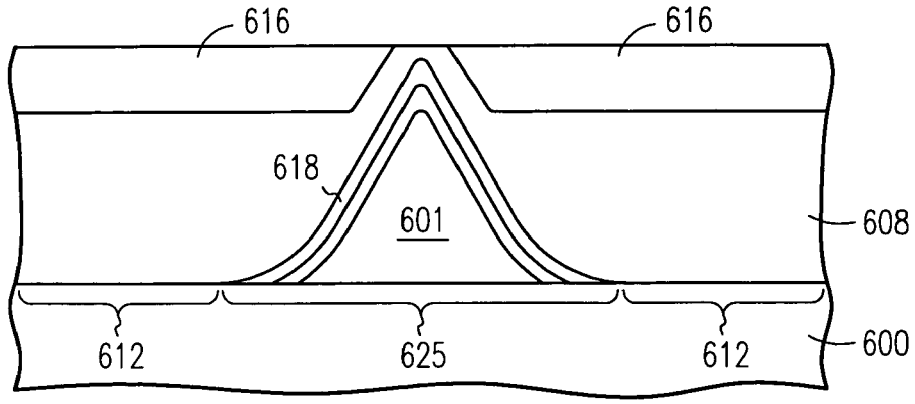

FIG. 6F shows the structure following the next stages of processing. Following deposition, the gate layer 616 undergoes a removal stage. In one embodiment, the gate layer 616 is removed until a portion of the insulator layer 608, covering the cathode tip 601, is revealed.

Figure 6G:
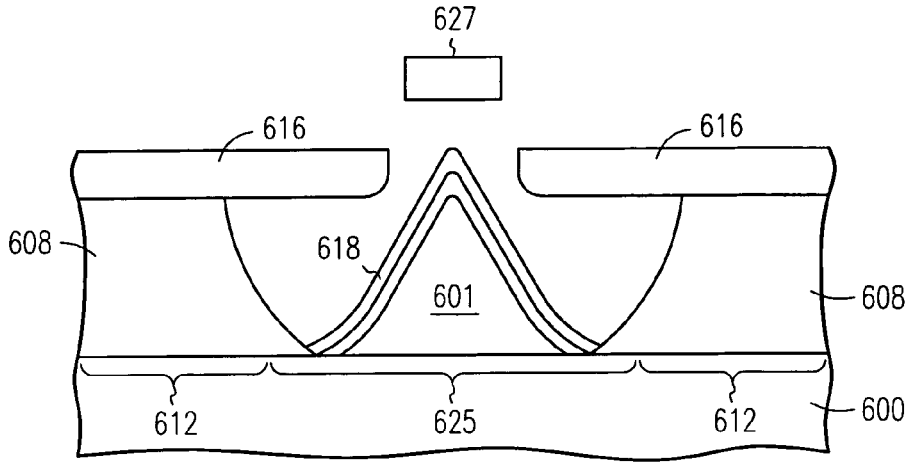

FIG. 6G shows the structure after the next sequence of processing. Here a portion of the insulator layer 608 is removed from the surrounding of the cathode tip 601. The portion of the insulator layer 608 is removed using any suitable technique as will be understood by one of ordinary skill in the field of semiconductor processing and field emission device fabrication. One exemplary technique includes a combination of a lift-off technique and reactive ion etching.

The formation of the anode 627 is further formed opposing the cathode tip 601 in order to complete the field emission device. The formation of the anode, and completion of the field emission device structure, can be achieved in numerous ways as will be understood by those of ordinary skill in the art of semiconductor and field emission device fabrication. The formation of the anodes and completion of the field emission device do not limit the present invention and as such are not presented in full detail here.

Figure 7:
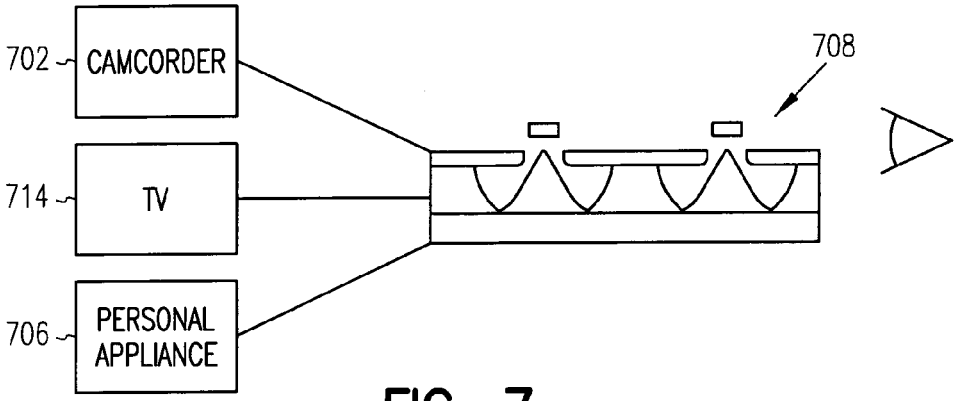
FIG. 7 illustrates a sample of commercial products using a video display according to one embodiment of the present invention.

FIG. 7 shows exemplary video display products using an array of field emitter devices 708 in accordance with an embodiment of the present invention. The array of field emitter devices 708 are described and presented above in connection with the above figures. In one embodiment, the video display product is a camcorder 702; the camcorder 702 includes a camcorder viewfinder incorporating an array of field emission devices. In another embodiment, the video display product is a flat-screen television 704 incorporating an array of field emission devices. In a further embodiment, the video display product is a personal appliance 706 incorporating an array of field emission devices. In all embodiments, the video display product includes a display screen for showing a video image.

Figure 8:
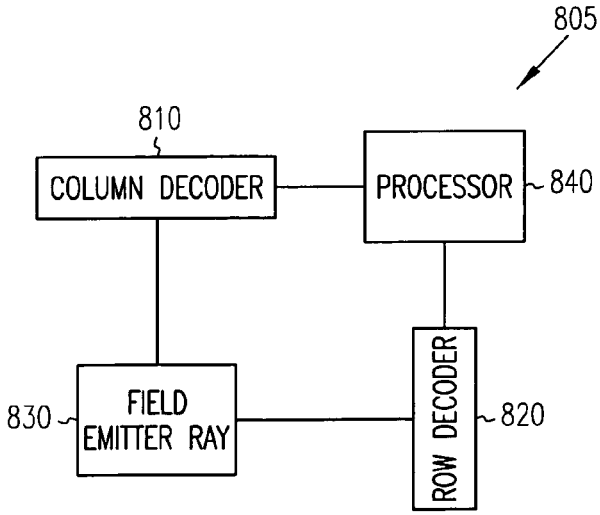
FIG. 8 is a block diagram that illustrates a flat panel display system according to one embodiment of the present invention.

FIG. 8 is a block diagram that illustrates an embodiment of a flat panel display system 850 according to an embodiment of the present invention. A flat panel display includes a field emitter array formed on a glass substrate. The field emitter array includes a field emitter array 830 as described and presented above in connection with the above Figures. A row decoder 820 and a column decoder 810 each couple to the field emitter array 830 in order to selectively access the array. Further, a processor 840 is included which is adapted to receiving input signals and providing the input signals to address the row and column decoders 820 and 810.

CONCLUSION

Thus, structures and methods have been described to enhance electron emission and to limit outgassing in field emitter devices. The various embodiments can be operated in severe environments, such as in temperatures above room temperature, in space applications, and in aqueous environments. Additionally, the invention is especially appropriate for mobile applications since it can be operated with a low power supply.

Although the specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A field emitter display device, comprising:

at least one emitter having an external coating, and an implanted oxide layer for releasing electrons at a predetermined energy level, wherein the implanted oxide layer is conforming to an entire surface of the emitter, and wherein the implanted oxide layer is underneath a surface of the emitter.

2. The device of claim 1, wherein the implanted oxide layer is formed for inhibiting outgassing including moisture.

3. A field emitter display device, comprising:

at least one emitter having an external coating, and an oxide implantation for releasing electrons at a predetermined energy level, wherein the oxide implantation is conforming to an entire surface of the emitter for lowering a potential barrier to enhance the releasing of electrons, and wherein the oxide implantation is underneath a surface of the emitter.

4. A field emitter display device, comprising:

at least one emitter having an external coating and an implantation for releasing electrons at a predetermined energy level, wherein the implantation is conforming to an entire surface of the emitter for lowering a potential barrier to enhance the releasing of electrons, wherein the implantation is a layer underneath the surface of the emitter.

5. A field emitter display device, comprising:

at least one emitter having an external coating, and an oxide implantation for emitting electrons at a predetermined energy level, wherein the oxide implantation is conforming to an entire surface of the emitter for affecting a lowering mechanism to enhance the emission of electrons, and wherein the oxide implantation is underneath a surface of the emitter.

6. A field emitter display device, comprising:

at least one emitter having an external coating and an implantation for emitting electrons at a predetermined energy level, wherein the implantation is conforming to an entire surface of the emitter for affecting a lowering mechanism to enhance the emission of electrons, wherein the implantation is a layer underneath the surface of the emitter.

7. A field emitter display device, comprising:

at least one emitter having an external coating, and an oxide implantation for releasing electrons at a predetermined energy level, wherein the oxide implantation is conforming to an entire surface of the emitter for affecting an image force to enhance the releasing of electrons, and wherein the oxide implantation is underneath a surface of the emitter.

8. A field emitter display device, comprising:

at least one emitter having an external coating and an implantation for releasing electrons at a predetermined energy level, wherein the implantation is conforming to an entire surface of the emitter for affecting an image force to enhance the releasing of electrons, wherein the implantation is a layer underneath the surface of the emitter.

9. A field emitter display device, comprising:

at least one emitter having an external coating, and an oxide implantation for emitting electrons at a predetermined energy level, wherein the oxide implantation is conforming to an entire surface of the emitter for enhancing the Schottky effect to enhance the emission of electrons, and wherein the oxide implantation is underneath a surface of the emitter.

10. A field emitter display device, comprising:

at least one emitter having an implantation for emitting electrons at a predetermined energy level, wherein the implantation is conforming to an entire surface of the emitter for enhancing the Schottky effect to enhance the emission of electrons, wherein the implantation is a layer underneath the surface of the emitter.

11. A field emitter display device, comprising:

at least one emitter having an external coating, and an oxide implantation for releasing electrons at a predetermined energy level, wherein the oxide implantation is conforming to an entire surface of the emitter for decreasing a dielectric effect of the emitter to enhance the releasing of electrons, and wherein the oxide implantation is underneath a surface of the emitter.

12. A field emitter display device, comprising:

at least one emitter having an implantation for releasing electrons at a predetermined energy level, wherein the implantation is conforming to an entire surface of the emitter for decreasing a dielectric effect of the emitter to enhance the releasing of electrons, wherein the implantation is a layer underneath the surface of the emitter.

13. A field emitter display device, comprising:

at least one emitter having an external coating, and an oxide implantation layer for releasing electrons at a predetermined energy level, wherein the oxide implantation layer is conforming to an entire surface of the emitter for enhancing the releasing of electrons and for limiting an outgassing to inhibit degradation of the emitter, wherein the oxide implantation layer is embedded in the surface of the emitter.

14. A field emitter display device, comprising:

at least one emitter having an external coating, and an oxide implantation layer for releasing electrons at a predetermined energy level, wherein the implantation layer is conforming to an entire surface of the emitter for lowering a potential barrier to enhance the releasing of electrons and for limiting an outgassing to inhibit degradation of the emitter, and wherein the oxide implantation layer is underneath a surface of the emitter.

15. A field emitter display device, comprising:

at least one emitter having an external coating and an implantation layer for releasing electrons at a predetermined energy level, wherein the implantation layer is conforming to an entire surface of the emitter for lowering a potential barrier to enhance the releasing of electrons and for limiting an outgassing to inhibit degradation of the emitter, wherein the implantation layer is embedded under the surface of the emitter.

16. A field emitter display device, comprising:

at least one emitter having an external coating, and an oxide implantation layer for releasing electrons at a predetermined energy level, wherein the oxide implantation layer is conforming to an entire surface of the emitter for affecting an image force to enhance the releasing of electrons and for limiting an outgassing to inhibit degradation of the emitter, wherein the oxide implantation layer is embedded in the surface of the emitter.

17. A field emitter display device, comprising:

at least one emitter having an external coating, and an oxide implantation layer for emitting electrons at a predetermined energy level, wherein the oxide implantation layer is conforming to an entire surface of the emitter for improving the Schottky effect to enhance the emission of electrons and for limiting an outgassing to inhibit degradation of the emitter, and wherein the oxide implantation layer is underneath a surface of the emitter.

18. A field emitter display device, comprising:

at least one emitter having an external coating and an implantation layer for emitting electrons at a predetermined energy level, wherein the implantation layer is conforming to an entire surface of the emitter for improving the Schottky effect to enhance the emission of electrons and for limiting an outgassing to inhibit degradation of the emitter, wherein the implantation layer is embedded under the surface of the emitter.

19. A field emitter display device, comprising:

at least one emitter having an external coating, and an oxide implantation layer for releasing electrons at a predetermined energy level, wherein the oxide implantation layer is conforming to an entire surface of the emitter for decreasing a dielectric effect of the emitter to enhance the releasing of electrons and for limiting an outgassing to inhibit degradation of the emitter, wherein the implantation layer is embedded in the surface of the emitter.

20. A field emitter display device, comprising:

at least one emitter having an external coating, and a silicon oxide ion implantation layer conforming to an entire surface of the emitter, and wherein the silicon oxide ion implantation layer is underneath a surface of the emitter.

21. A field emitter display device, comprising:

at least one emitter having an external coating, and an oxide implantation layer conforming to an entire surface of the emitter for releasing electrons at a predetermined energy level, wherein the oxide implantation layer is underneath a surface of the emitter.

22. A field emitter display device, comprising:

at least one emitter having an external coating, and an embedded silicon oxide layer conforming to an entire surface of the emitter.

23. The device of claim 22, wherein the embedded silicon oxide layer is formed by an implantation process.

24. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for enhancing the releasing of electrons.

25. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for lowering a potential barrier to enhance the releasing of electrons.

26. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for affecting a lowering mechanism to enhance an emission of electrons.

27. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for affecting an image force to enhance the releasing of electrons.

28. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for improving the Schottky effect to enhance an emission of electrons.

29. A field emitter display device, comprising:

at least one emitter having an external coating and an embedded oxide layer for releasing electrons at a predetermined energy level, wherein the embedded oxide layer is conforming to an entire surface of the emitter for limiting an outgassing to inhibit degradation of the emitter and for decreasing a dielectric effect of the emitter to enhance the releasing of electrons.

30. A field emitter display device, comprising:

at least one emitter having an external coating, and an oxide implantation for releasing electrons at a predetermined energy level, wherein the oxide implantation is conforming to an entire surface of the emitter for reducing a potential barrier to enhance the releasing of electrons and for inhibiting degradation of the emitter in the presence of the outgassing, and wherein the oxide implantation is underneath a surface of the emitter; and a light-emitting target for radiating in response to the released electrons.

31. The device of claim 30, wherein the light-emitting target is coated with luminescent matter.

32. The device of claim 30, wherein the light-emitting target is coated with phosphorescent matter.

33. A video display, comprising:

a display screen for showing a video image; and an array of field emission devices for forming the video image, wherein the array of field emission devices comprises:

at least one emitter having an external coating, and an oxide implantation for releasing electrons at a predetermined energy level, wherein the oxide implantation is conforming to an entire surface of the emitter for reducing a dielectric effect of the emitter and is stable in the presence of the outgassing, and wherein the oxide implantation is underneath a surface of the emitter; and a light-emitting target for radiating in response to the released electrons.

* * * * *